US010060380B2

(12) United States Patent
Ramamurthy et al.

(10) Patent No.: US 10,060,380 B2
(45) Date of Patent: Aug. 28, 2018

(54) INTER-CONNECT CIRCUIT DEVICE FOR VEHICLE FUEL DELIVERY SYSTEM

(71) Applicants: DENSO International America, Inc., Southfield, MI (US); DENSO CORPORATION, Kariya, Aichi-pref. (JP)

(72) Inventors: Dhyana Ramamurthy, Novi, MI (US); Hiroshi Katsurahara, Kariya (JP); Atsushi Koike, Kariya (JP)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 15/188,456

(22) Filed: Jun. 21, 2016

(65) Prior Publication Data

US 2017/0363033 A1 Dec. 21, 2017

(51) Int. Cl.
*F02D 41/30* (2006.01)

(52) U.S. Cl.
CPC ..... *F02D 41/30* (2013.01)

(58) Field of Classification Search
CPC ..... F02D 1/00; F02D 41/20; F02D 41/2096; F02D 2041/202; F02D 2041/2082; F02D 2400/22; F02M 49/00; F02M 51/00; F02M 51/005; F02M 51/0603; F02M 57/00
USPC ..... 123/478–481, 490, 472
See application file for complete search history.

(56) References Cited

U.S. PATENT DOCUMENTS 7,055,494 B2 * 6/2006 Nishimaki ..... F02D 41/20 123/299
7,124,741 B2 * 10/2006 Cagnoni ..... F02D 41/20 123/472
2004/0223856 A1 * 11/2004 Rembold ..... F02M 59/366 417/222.2
2006/0166519 A1 * 7/2006 Telep ..... H02K 11/33 439/34
2006/0202677 A1 * 9/2006 Schmidt ..... G01D 5/145 324/207.2
2006/0213484 A1 * 9/2006 Schmidt ..... F02D 9/00 123/399
2008/0147292 A1 * 6/2008 Remele ..... F02D 41/2096 701/102
2010/0175375 A1 * 7/2010 Gilch ..... F01D 17/10 60/602
2011/0283975 A1 * 11/2011 Wirrer ..... F02D 41/20 123/478
2011/0294397 A1 * 12/2011 Tsai ..... A63H 33/005 446/454

(Continued)

*Primary Examiner* — John Kwon
*Assistant Examiner* — Johnny H Hoang
(74) *Attorney, Agent, or Firm* — Harness, Dickey & Pierce, P.L.C.

(57) ABSTRACT

An inter-connect circuit (ICC) device for a fuel delivery system of a vehicle is disposed between an engine control unit (ECU) and a fuel control device. The ECU transmits a drive pulse to the fuel control device by way of a drive pulse line passing through the ICC device. The ICC device includes a housing and a sense circuit. The housing has a first side that is connectable to the ECU and a second side different from the first side that is connectable to the fuel control device. The sense circuit is disposed within the housing. The sense circuit is electrically coupled to the drive pulse line by way of a sense circuit line and is communicably coupled to the ECU by way of a data communication line.

19 Claims, 4 Drawing Sheets

(56) References Cited

U.S. PATENT DOCUMENTS

| | | | | |
|---|---|---|---|---|
| 2012/0048239 | A1* | 3/2012 | Jalal | F02D 41/2096 123/472 |
| 2016/0115896 | A1* | 4/2016 | Kanbara | F02D 41/403 123/478 |
| 2016/0222892 | A1* | 8/2016 | Akazaki | F02D 35/023 |

* cited by examiner

INTER-CONNECT CIRCUIT DEVICE FOR VEHICLE FUEL DELIVERY SYSTEM

FIELD

The present disclosure relates to a fuel delivery control system for an internal combustion engine.

BACKGROUND

This section provides background information related to the present disclosure which is not necessarily prior art.

Internal combustion engines typically have a fuel delivery system where fuel is drawn from a fuel tank and delivered via a fuel line into the engine. The fuel is injected into a combustion chamber of the engine by fuel injectors, where it is mixed with drawn ambient air, compressed by a compression device, such as a piston-cylinder, and ignited to cause combustion of the air-fuel mixture. The combustion gases generally expand to do work on the compression device, such as moving the piston to drive a crankshaft. The combustion gases are typically then expelled from the combustion chamber through an exhaust of the engine.

Recently, with sustained high fuel prices and increased fuel economy and emissions regulation standards, there is a demand for highly efficient engines that cut emissions and fuel consumption compared to conventional engines. One way to minimize fuel consumption and ensure effective combustion is to control the operation of fuel control devices, such as fuel injectors and high pressure fuel pumps, For example, by controlling the actuation of the valve within the fuel injectors, an appropriate amount of fuel can be supplied to the combustion chamber at the appropriate time.

An engine control unit (ECU), which may also be known as a powertrain control module (PCM), monitors and controls the operation of multiple components in the engine to control the performance of the engine. For example, the ECU may monitor the performance of the fuel injectors by way of sensors and apply drive signals to the fuel injectors to control the opening/closing operation of the fuel injectors. The ECU can be tasked with handling increasing amounts of sensed information, which can slow down processing of information sent to the ECU. Additionally, the ECU may control other components of the engine. Accordingly, if calibration data or the fuel injector control program has to be updated, the entire ECU may need to be replaced, which can be expensive.

SUMMARY

This section provides a general summary of the disclosure, and is not a comprehensive disclosure of its full scope or all of its features.

The present disclosure provides for an inter-connect circuit (ICC) device for a fuel delivery system of a vehicle. The ICC device is disposed between an engine control unit (ECU) and a fuel control device. The ECU transmits a drive pulse to the fuel control device by way of a drive pulse line passing through the ICC device. The ICC device includes a housing and a sense circuit. The housing has a first side that is connectable to the ECU and a second side different from the first side that is connectable to the fuel control device. The sense circuit is disposed within the housing. The sense circuit is electrically coupled to the drive pulse line by way of a sense circuit line and is communicably coupled to the ECU by way of a data communication line.

In a feature of the present disclosure, the sense circuit may be programmed to monitor the drive pulse being transmitted through the drive pulse line and provide feedback information to the ECU. Based on the feedback information from the sense circuit, the ECU may adjust the drive pulse transmitted to the fuel control device.

Further areas of applicability will become apparent from the description provided herein. The description and specific examples in this summary are intended for purposes of illustration only, and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

A fuel control device, such as a fuel injector and/or a high pressure fuel pump, operates to supply fuel to an engine. An engine control unit (ECU) provides a drive pulse to the fuel control device to actuate a valve within the fuel control device. The ECU may control the actuation of the valve by adjusting the drive pulse, such that the valve of the fuel control device opens and closes at optimum times.

To ensure optimal control of the fuel control device and decrease the processing load on the ECU, an inter-connect circuit device of the present disclosure performs an initial processing of the drive pulse being transmitted by the ECU. More particularly, the inter-connect circuit device includes a sense circuit that senses required signals, performs predetermined computations, such as voltage differential, and transmits feedback information to the ECU. Using the feedback information, the ECU may adjust the drive pulse to the fuel control device. Accordingly, the inter-connect circuit device and the ECU form a modular control system for controlling the fuel control device. In addition to having a sense circuit, the inter-connect circuit device includes a housing that is configured to electrically couple the ECU to the fuel control device, such that the drive pulse is transmitted from the ECU to the fuel control device by way of the inter-connect circuit device.

Figure 1:
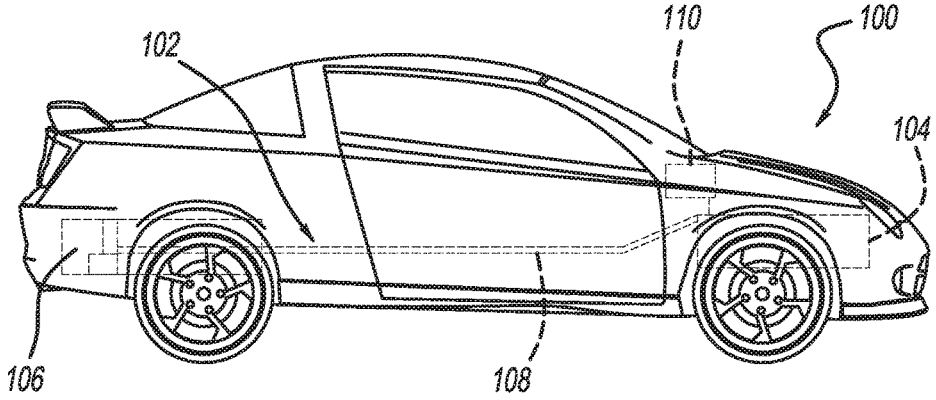
FIG. 1 is a side view of a vehicle including a fuel delivery system according to present teachings.

The present disclosure will now be described more fully with reference to the accompanying drawings. FIG. 1 is a side view of a vehicle 100 including a fuel delivery system 102. The vehicle 100 may be, for example, an automobile, truck, watercraft, aircraft, or other machinery. The fuel delivery system 102 generally includes an engine 104 connected to a fuel tank 106 via a fuel supply line 108. The engine 104 may be configured to run on any type of suitable fuel, such as diesel, gasoline, ethanol, or natural gas.

Figure 2:
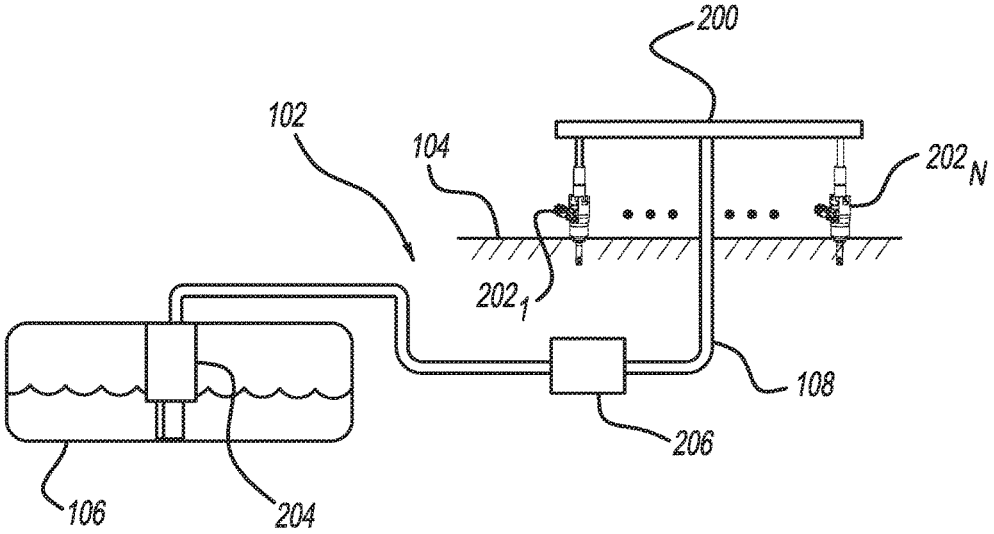
FIG. 2 is a schematic depicting the fuel delivery system according to the present teachings.

FIG. 2 is a schematic depicting the fuel delivery system 102. The fuel delivery system 102 generally includes a fuel injector rail 200, which may also be a common rail. The fuel injector rail 200 is connected to one or more fuel injectors 202 (e.g., fuel injectors $\mathbf{202}_1$ to $\mathbf{202}_N$, where N is an integer greater than or equal to 1). The number of fuel injectors 202 may vary depending on the size of the engine 104, the number of cylinders in the engine 104, and other suitable parameters. The fuel injector 202 may be considered a type of fuel control device.

The fuel injector rail 200 is also connected to the fuel supply line 108. The fuel supply line 108 is connected to the fuel tank 106 and a fuel pump 204, which may be placed within the fuel tank 106. For direct-injection engines, an additional high pressure fuel pump 206, which may also be considered as a type of fuel control device, may be included along the fuel supply line 108.

During operation of the engine 104, fuel is pumped from the fuel tank 106 by the fuel pump 204 and carried through the fuel supply line 108 to the high pressure fuel pump 206. The high pressure fuel pump 206 pressurizes the fuel, and further sends the fuel through the fuel supply line 108 to the fuel injector rail 200, where the fuel is distributed to each fuel injector 202.

Each fuel injector 202 in a direct injected engine includes a valve, and a solenoid that, when energized by a drive pulse, opens the valve to deliver fuel into a combustion chamber within the engine 104. In the combustion chamber, the fuel is mixed with air and burned to produce power for moving the vehicle 100. The actuation of each fuel injector 202 is controlled by an engine control unit (ECU) 110 (FIG. 1). More particularly, the injector driver, which is typically located within the ECU 110, transmits the drive pulse to the fuel injectors 202. Upon initial pulse, there may be a time delay before the solenoids of the fuel injectors 202 begin to open the valve from a closed position to a partially open position. As the valve steadily opens, fuel flow increases until the flow reaches a maximum flow rate at a fully open position of the valve, where the continued drive pulse holds the valve fully open. Once the drive signal pulse ends, the valve begins to close, and the flow of fuel steadily decreases until the valve fully closes and the fuel flow ceases.

Figure 3:
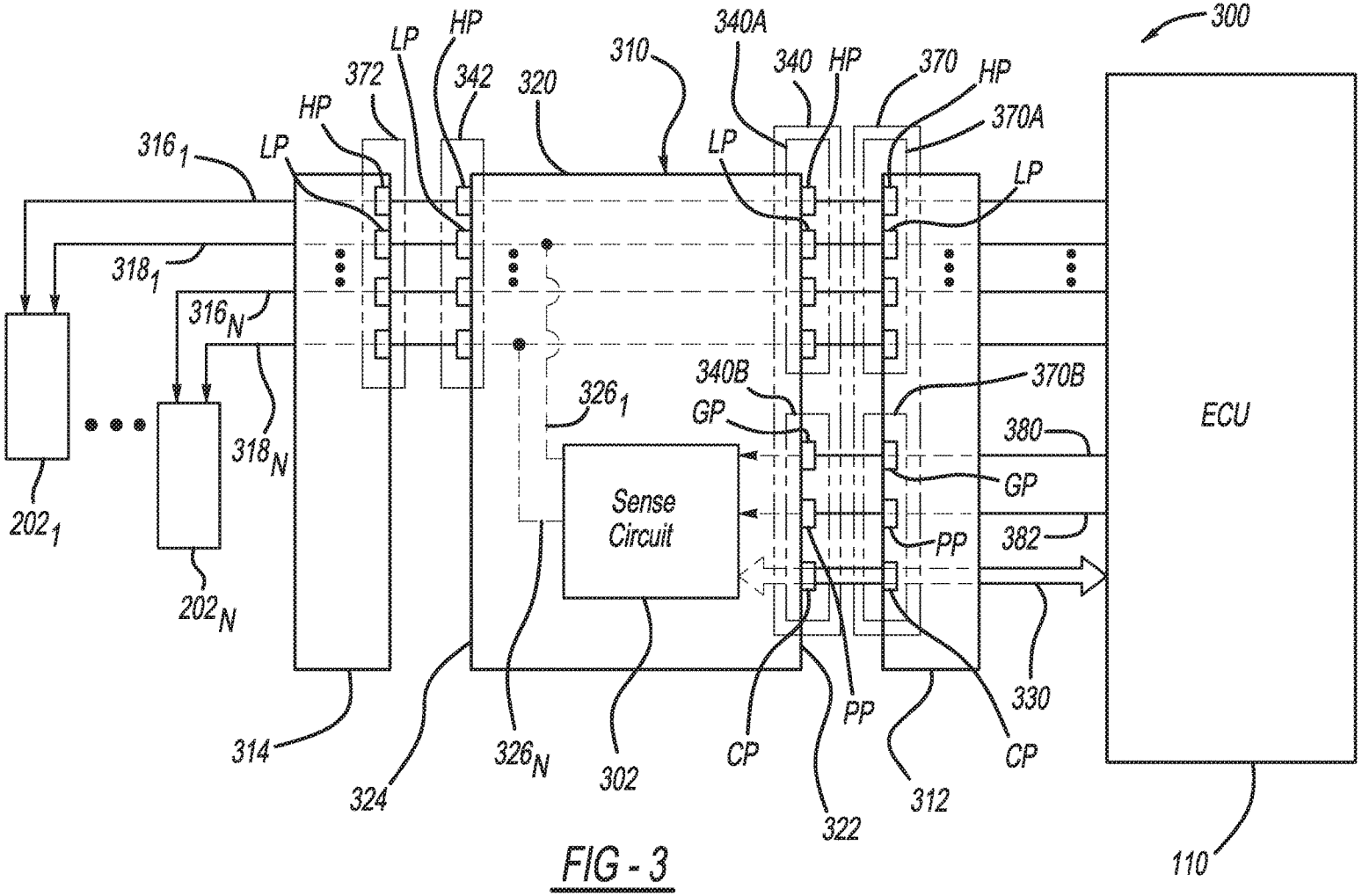
FIG. 3 is a schematic of a fuel injection control system including a fuel injector and an inter-connect circuit device in a first embodiment.

With reference to FIG. 3, a fuel injection control system 300 is presented. The fuel injection control system 300 includes the ECU 110, a sense circuit 302, and the fuel injectors 202. The ECU 110 is electrically coupled to the fuel injectors by way of an inter-connect circuit (ICC) device 310 of the present disclosure. The ICC device 310 is electrically and communicably coupled to the ECU 110 by way of an ECU harness 312, and is electrically coupled to each of the fuel injectors 202 by way of a fuel injector (FI) connector 314, The injector driver in the ECU 110 transmits the drive pulse for each fuel injector 202 by way of a high voltage line 316 and low voltage line 318, which may collectively be referred to as drive lines 316, 318. The fuel injection control system 300 includes a designated drive line 316, 318 for each of the fuel injectors 202 (i.e., high voltage line $\mathbf{316}_1$ to $\mathbf{316}_N$ and low voltage lines $\mathbf{318}_1$ to $\mathbf{318}_N$).

The ICC device 310 includes a housing 320 and the sense circuit 302. The housing 320 includes an ECU side 322 (i.e., a first side) that connects to the ECU harness 312 and a fuel injector side 324 (i.e., a second side) that connects to the FI connector 314. Internal circuitry within the housing 320 forms a portion of the drive line 316, 318 to allow the drive pulse transmitted from the ECU 110 to flow from the ECU side 322 to the fuel injector side 324 of the ICC device 310. From the fuel injector side 324, the drive pulse is transmitted to the FI connector 314 and to the respective fuel injector 202

The sense circuit 302 may be an application specific integrated circuit (ASIC) that is programmed to detect and analyze the current or voltage present in the drive lines. The sense circuit is located at the housing 320. For example, the sense circuit 302 may be located within, or embedded inside, the housing 320 to protect the sense circuit 302 against damage from external elements. The sense circuit 302 monitors the drive pulse being supplied to the fuel injectors 202. Specifically, by way of internal circuity within the housing 320, the sense circuit 302 is electrically coupled to the drive line 316, 318. For example, as illustrated in FIG. 3, the sense circuit 302 is electrically coupled to the low voltage line 318 for each fuel injector 202 by way of an injector sense circuit line 326 (i.e., $\mathbf{326}_1$ to $\mathbf{326}_N$) formed within the housing 320. By way of the injector sense circuit lines 326, the sense circuit 302 detects a profile of the voltage across the Hi and Lo lines.

The ECU 110, in conjunction with the sense circuit 302, may form a closed-loop control system for adjusting the drive pulse applied to each fuel injector 202. Specifically, each fuel injector 202 may be controlled to open and close at an optimal time to ensure complete combustion of the fuel-air mixture in the combustion chamber. The valve position of fuel injector 202 may be determined by tracking a profile (e.g., voltage or current profile) of the respective drive pulse being applied to the fuel injector 202. The sense circuit 302 is configured to analyze the detected profile and transmit feedback data to the ECU 110. Specifically, the sense circuit 302 transmits data to the ECU 110 by way of a data communication line 330. The data communication line 330 communicably couples the sense circuit 302 to the ECU 110 and is configured to transmit data digitally. Based on the feedback data, the ECU 110 may adjust the drive pulse to adjust the time at which the valve of the fuel injector 202 opens and closes.

Figure 4:
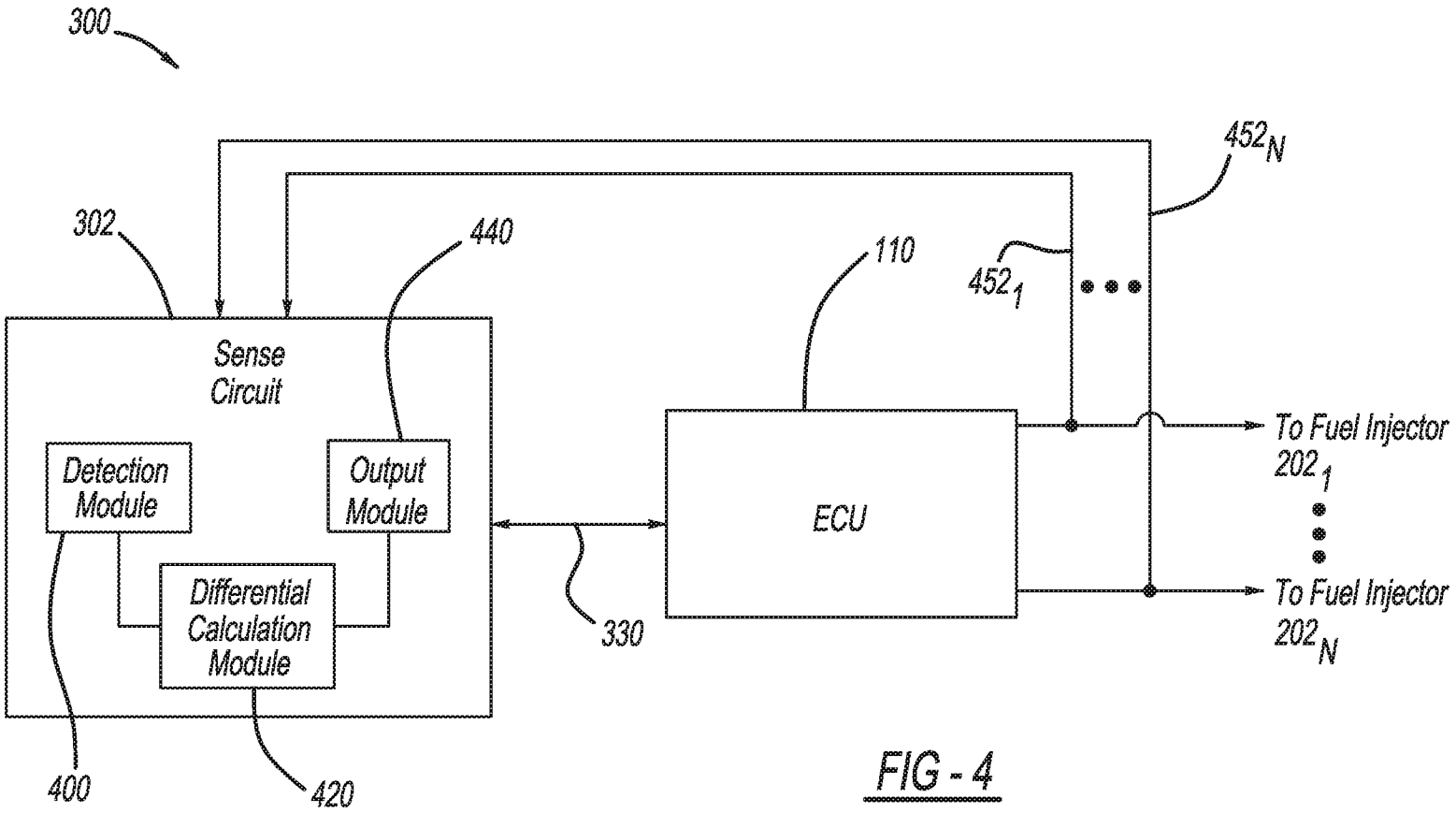
FIG. 4 is a functional block diagram of the fuel delivery control system of the first embodiment.

With reference to FIG. 4, an example functional block diagram of the system 300 is presented. The sense circuit 302 may be configured to include a detection module 400, a differential calculation module 420, and an output module 440. In the system 300, the ECU 110 transmits a drive pulse to the fuel injector as represented by lines $\mathbf{450}_1$ to $\mathbf{450}_N$. The sense circuit 302 receives a feedback of each drive pulse, as indicated by lines 452 (i.e., $\mathbf{452}_1$ to $\mathbf{450}_N$).

In an example of the control system 300, as the ECU 110 sends a drive pulse to a given fuel injector 202, the detection module 400 senses the low side voltage across the injector sense circuit line 326. Specifically, the ECU 110 transmits a voltage pulse through the high voltage line 316 and the low voltage line 318 to a given fuel injector 202 to activate the solenoid in the fuel injector 202.

In the example embodiment, the detection module 400 transmits the sensed low side voltage to the differential calculation module 420. The differential calculation module 420 performs initial processing of the sensed low side voltage, and sends the initially processed low side voltage to the output module 440. The initial processing performed by the differential calculation module 420 may include, for example, calculating an instantaneous voltage differential value of the low side voltage applied to the fuel injector 202, or calculating a rate of voltage change over time.

The output module 440 outputs the information as feedback data to the ECU 110 through the data communication line 330. The ECU 110 performs a higher level processing of the processed signals, and adjusts the driving signal to be sent to the fuel injectors 202 based on the higher level processing. This cycle can be repeated as needed at any time when the fuel injector is in operation.

The instantaneous voltage differential value determined by the differential calculation module 420 can be used to determine the position of the valve. For example, the low side voltage corresponds with an electro-mechanical force generated by the drive pulse to open the valve in the fuel injector 202. When the low side voltage increases, the valve of the injector 202 is lifted towards a partial lift position. Fuel pressure to the valve decreases as fuel is sprayed into a combustion chamber by the fuel injector 202, causing a rate of change in the drive voltage to drop. Upon continued application of the drive pulse, the valve continues to open until it achieves full lift.

Once the drive pulse is complete, drive voltage decreases and the valve begins to move towards a closed position from full lift creating a second rate of drive voltage change as the flow of fuel from the fuel injector 202 decreases. When the valve fully closes and impacts its valve seat in the fuel injector 202, a third rate of the drive voltage change is created. Thus, by determining the occurrence of the different drive voltage changes, the valve position of the fuel injector 202 can be estimated. While three distinct drive voltage changes were discussed, other drive voltage changes may also be detected.

In the example embodiment, the feedback data includes the voltage differential calculated by the differential calculation module 420. Based on the feedback data, the ECU 110 analyzes the voltage differential values rate. For example, the ECU 110 may compare the voltage differential values to predetermined thresholds to infer the valve position of the fuel injectors 202.

Based on the inferred valve position and the desired valve position, the ECU 110 may adjust the drive pulse of the fuel injector. As an example, when adjusting the drive pulse of the fuel injector, the ECU 110 may evaluate the time it takes for the valve to close and adjust the drive pulse to compensate for the delayed or premature closing of the valve.

The ECU 110 and the sense circuit 302 may be configured in various suitable ways for forming the closed-loop control system, and should not be limited to the examples described herein. For example, while the sense circuit 302 is described as detecting the current profile of the fuel injector 202, the sense circuit 302 may also be configured to detect a voltage profile of the fuel injector. Accordingly, to detect the voltage profile, the injector sense circuit line 326 may be configured to electrically couple the injector sense circuit line 326 to both the low voltage line 318 and the high voltage line 316. Furthermore, the sense circuit 302 may provide other feedback data to the ECU 110, and should not be limited to the differential voltage described herein. The injector sense circuit line 326 may also be referred to as a sense circuit line.

With continuing reference to FIG. 3, the ICC device 310 includes ECU ports 340 and fuel injector ports 342. The ECU ports 340 are positioned along the ECU side 322 of the housing 320, and the fuel injector ports 342 are disposed along the fuel injector side 324. The ECU ports 340 and the fuel injector ports 342 are electrically coupled to each other by circuity within the housing 320 to form a portion of the drive lines 316, 318.

The ECU ports 340 include injector drive ports 340A and sense circuit ports 340B. The ECU ports 340 are connectable to injector ports 370 of the ECU harness 312. The injector ports 370 of the ECU harness 312 include drive ports 370A and sense circuit ports 370B. The injector ports 370 and the ECU ports 340 are configured to couple to each other, such that the drive ports 340A of the ICC device 310 connect to respective drive ports 370A of the ECU harness 312 and the sense circuit ports 340B of the ICC device 310 connect to respective sense circuit ports 370B of the ECU harness 312.

The ICC device 310 is connectable to the FI connector 314 by way of the fuel injector ports 342. Specifically, the FI connector 314 includes drive ports 372 that connect to respective injector ports 342 of the ICC device 310.

The drive lines 316, 318 for each fuel injector 202 extend between the ECU 110, the ICC device 310, the FI connector 314, and the fuel injectors 202. Since each fuel injector 202 is connected to the high voltage line 316 and the low voltage line 318, the ICC device 313, the ECU harness 312, and the FI connectors have two designated ports for each fuel injector 202. Specifically, for the ICC device 310, the drive port 340A of the ECU ports 340 and the injector ports 342 include a low port LP and a high port HP for each fuel injector. Accordingly, the drive ports 343A of the ECU ports 340 and the fuel injector ports 342 have $2^N$ ports, where N is the number of fuel injectors 202.

Similar to the ICC device 310, the drive ports 372 of the FI connector 314 and the drive ports 370A of the ECU harness 312 each include a high port HP and low port LP for each fuel injector 202. Thus, the drive ports 370A of the ECU harness 312 and the drive ports 372 of the FI connector 314 also include $2^N$ ports for the fuel injectors 202.

In addition to the drive ports 370A, the ICC device 310 is connected to the ECU 110 by way of sense circuit ports 340B. The sense circuit ports 340B of the ECU ports 340 electrically and communicably couple the sense circuit 302 to the ECU 110. Specifically, the sense circuit ports 340B of the ICC device 310 include a communication port CP, a power port PP, and a ground port GP. Similarly, the sense circuit port 370B of the ECU harness 312 includes a communication port CP, a power port PP, and a ground port GP. The communication ports CP communicably couple the sense circuit 306 and the ECU 110, such that the sense circuit 302 communicates with the ECU 110 by way of the data communication line 330. The power ports PP and the ground ports GP couple the sense circuit 302 to a ground line 380 and a power line 382 through which electrical power is supplied to the sense circuit 302 from the ECU 110.

The ICC device 310 includes more ports along the ECU side 322 than the fuel injector side 324. More particularly, the number of ECU ports 340 is equal to the number of drive ports 340A (e.g., $2^N$) plus the number of sense circuit ports (e.g., 3), and the number of fuel injector ports 342 is equal to the number of drive ports 370A (e.g., $2^N$). That is, the ECU ports 340 include additional ports for connecting the sense circuit 302 and the ECU 110.

The ICC device 310 can be configured in various suitable ways for connecting to the ports 370 of the ECU harness 312 and the ports 372 of the FI connector 314. For example, the ECU ports 340 and the fuel injector ports 342 of the ICC device 310 may include pins that interface with holes formed at the ECU harness 312 and the FI connector 314 (i.e., male-female connection). The ECU ports 340 may also be configured differently from the fuel injector ports 342. As an example, the ECU ports 340 may include pins that can be inserted into holes formed at the ECU harness 312, and the fuel injector ports 342 may define holes for receiving pins provided at the FI connector 314.

The ICC device 310 of the present disclosure is structurally configured to electrically couple the ECU 110 to one or more fuel injectors 202 and to convey feedback information to the ECU 110 by way of the sense circuit 302 disposed within the housing 320 of the ICC device 310. Specifically, the ICC device 310 and the ECU 110 form a modular system for operating and controlling the fuel injector 202. By having the sense circuit 302 located external of the ECU 110, possible upgrades related to the processing performed by the sense circuit 302 may be easily implemented. For example, when new sensing parameters for optimizing fuel delivery are available, only the ICC device 310 has to be replaced; the existing ECU 110 can remain without modifications. This way, the cost of upgrades is greatly reduced.

Furthermore, by separating the sensing of the drive pulse and initial processing functionalities performed by the sense circuit 302 from the ECU 110, the amount of processing performed by the ECU 110 may be reduced. A decrease in processing may further reduce the heat dissipation of the ECU 113. As the ECU 110 operates at a cooler temperature, existing processing elements of the ECU 110 may operate at higher performance limits, with extended life time.

The ICC device 310 also allows for the sensing of the drive pulse to be closer to the fuel injectors 202. Specifically, the sense circuit 202 may be positioned closer to the fuel injector 202 than the ECU 110 is. By being closer to the fuel injector 202, noise interference of the sensing of the drive pulse can be reduced, thereby improving the quality of sensing of the drive pulse.

Further, since the sense circuit 302 embedded in the ICC device 310 performs the sensing and initial processing functions, the processing resource within the ECU 110 is freed to perform higher level data level processing. The processing load and time of the ECU 110 may be greatly reduced as a result, allowing for improved performance by the ECU 110.

Additionally, the ICC device 310 and the sense circuit 302 embedded in the ICC device 310 are designed to work with the existing ECU 110. As such, the sense circuit 302 may have additional circuitry or issue signals across the data communication line 330 to complement or override redundant information that may be sensed by the ECU 110 through existing sensors. As an example, the sense circuit 302 may issue commands to shut off redundant sensing circuits in the existing ECU 110, freeing the ECU 110 resources to perform higher-level data processing, and cooling the existing ECU 110 to improve performance.

Figure 5:
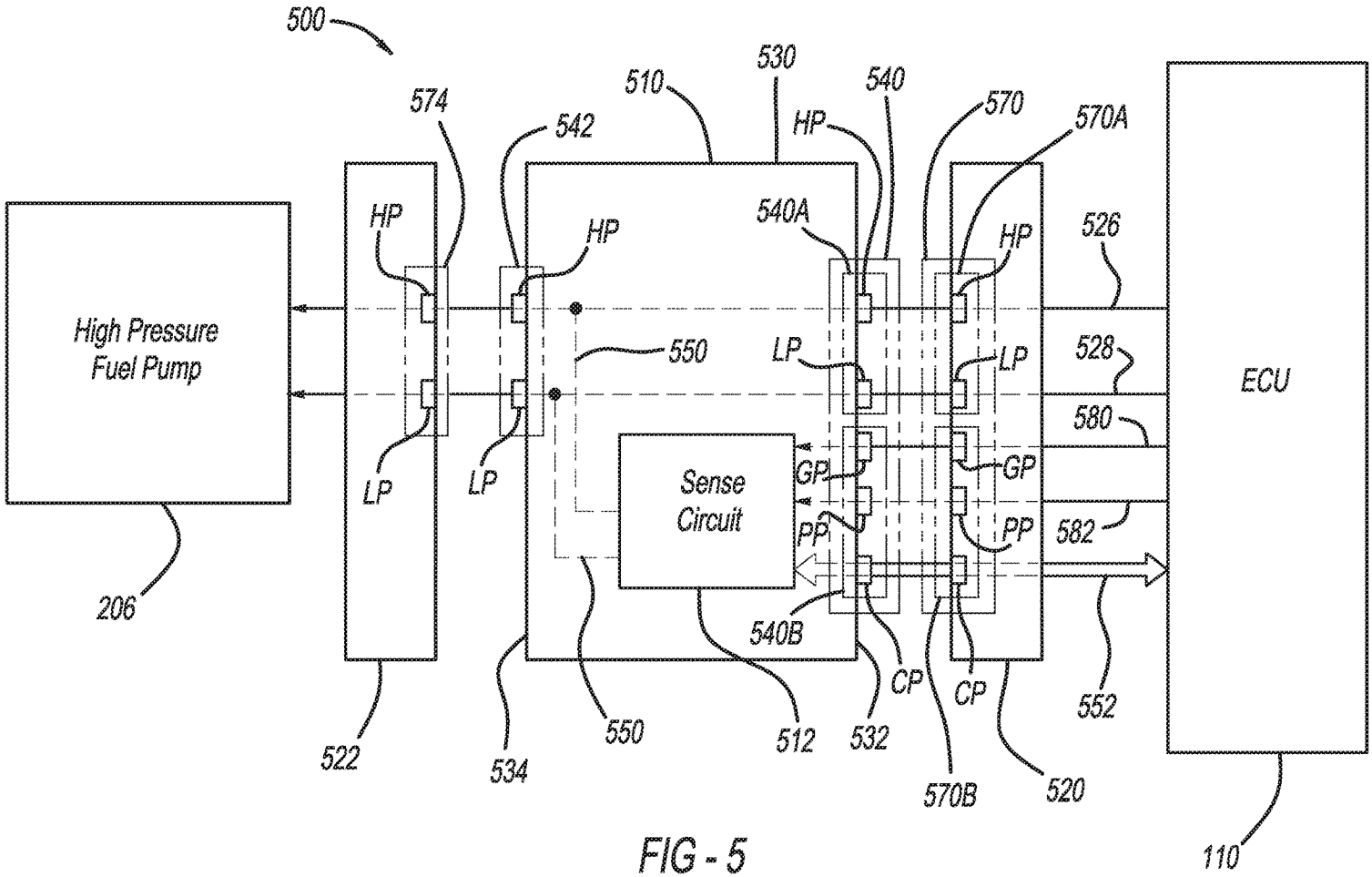
FIG. 5 is a schematic of a fuel pump control system including a fuel pump and an inter-connect circuit device in a second embodiment.

The ICC device of the present disclosure may be configured to electrically coupled the ECU 110 with other fuel control devices and provide feedback data regarding a control signal supplied to the fuel control device from the ECU 110. As an example, in a second embodiment of the present disclosure, FIG. 5 illustrates a fuel pump control system 500 that includes the high pressure fuel pump 206, the ECU 110, and an ICC device 510 having a sense circuit 512. The ICC device 510 is electrically and communicably coupled to the ECU 110 by way of an ECU harness 520, and is electrically coupled to the fuel pump 206 by way of a fuel pump connector 522.

The ICC device 510 electrically couples the high pressure fuel pump 206 and the ECU 110, such that the ECU 110 transmits a drive pulse to the high pressure fuel pump 206. Specifically, the drive pulse activates a solenoid valve within the high pressure fuel pump 206 to control the actuation of the solenoid valve. The drive pulse is transmitted by way of a high voltage line 526 and a low voltage line 528, which are collectively referred to as drive line 526, 528.

Similar to the ICC device 310 of the first embodiment, the ICC device 510 includes a housing 530 and the sense circuit 512 that may be located within the housing 530. The housing 530 includes an ECU side 532 (i.e., a first side) and a fuel pump side 534 (i.e., a second side).

The ICC device 510 includes ECU ports 540 and fuel pump ports 542. The ECU ports 540 are positioned along the ECU side 532 of the housing 530, and the fuel pump ports 542 are disposed along the fuel injector side 324. A portion of the ECU ports 540 are connected to the fuel pump ports 542 by way of a circuity within the housing 320 to form a portion of the drive line 526, 528

The ECU ports 540 include pump drive ports 540A and sense circuit ports 540B. The ECU ports 540 are connectable to pump ports 570 of the ECU harness 520. The pump ports 570 of the ECU harness 520 include drive ports 570A and sense circuit ports 570B. The pump ports 570 and the ECU ports 540 are configured to couple to each other such that the drive ports 540A of the ICC device 510 connect to drive ports 570A of the ECU harness 312 and the sense circuit ports 540B of the ICC device 510 connect to sense circuit ports 570B of the ECU harness 520.

The ICC device 510 is connectable to the fuel pump connector 522 by way of the fuel pump ports 542. Specifically, the fuel pump connector 522 includes drive ports 574 that connect to the fuel pump ports 542 of the ICC device 510.

The drive ports 540A and fuel pump ports 542 of the ICC device 510 connect to the drive ports 570A of the ECU 110 and the drive ports 574 of the fuel pump connector 522, respectively. Accordingly, the drive pulse transmitted from the ECU 110 is received by the fuel pump 240 to actuate the valve of the fuel pump 240 by way of the ICC device 510. The drive ports 540A and fuel pump ports 542 of the ICC device 510 each include a high port HP and a low port LP for the high voltage line 526 and the low voltage line 528, respectively.

By way of internal circuity within the housing 530, the sense circuit 512 is electrically coupled to the drive line 526, 528 by way of one or more sense circuit lines 550. More particularly, similar to the first embodiment, the sense circuit 512 detects a profile of the drive pulse transmitted through the drive line 526, 528. The sense circuit 512 performs an initial processing of the fuel pump drive pulse using controls algorithms programmed in the sense circuit 512. For example, the sense circuit 512 may calculate an instantaneous current differential, which may be graphically represented over time as a slope of the applied current. The instantaneous current differential is then output to the ECU 110 as feedback data through a data communication line 552. Using the instantaneous current differential and predetermined operation values, the ECU 110 may adjust the drive pulse supplied to the fuel pump 240 in order to have the solenoid valve of the fuel pump 240 open and close at optimum times.

Similar to the first embodiment, the sense circuit ports 540A of the ICC device 510 electrically and communicably couple the sense circuit 512 to the ECU 110. Specifically, the sense circuit ports 540A of the ICC device 310 include a communication port CP, a power port PP, and a ground port GP. The sense circuit port 570B of the ECU harness 312 includes a communication port CP, a power port PP, and a ground port GP. The communication ports CP communicably couple the sense circuit 512 to the ECU 110, the sense circuit 512 communicates with the ECU 110 via the communication line 552. The power ports PP and the ground ports GP couple the sense circuit 512 to a ground line 580 and a power line 582 through which electrical power is supplied to the sense circuit 512 from the ECU 110.

The ICC device of the present disclosure provides for a modular sensing device that may allow for easy upgradability to the fuel delivery control system without costly modification to the existing ECU. Also, the ICC device may allow the existing ECU to operate in a cooler environment, optimizing performance limits and extending the life of the ECU components. By decoupling sensing and initial processing functionalities performed by the sense circuit, the ICC device may allow the ECU to perform higher level processing of the feedback information to optimize the drive signal to apply to the fuel injection components. Additionally, the ICC device 310 may allow sensing of fuel injection performance parameters to be done with lower noise interference, resulting in more accurate feedback information for the ECU 110 to process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art, Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

In this application, including the definitions below, the terms "module," "controller," and/or "unit," may be replaced with the term "circuit." The terms "module" and "unit" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

What is claimed is:

1. An inter-connect circuit device for a fuel delivery system of a vehicle, the inter-connect circuit disposed between an engine control unit and a fuel control device and transmitting a drive pulse from the engine control unit to the fuel control device by way of a drive pulse line, the inter-connect circuit device comprising:

a housing having a first side and a second side, wherein the first side is connectable to the engine control unit and the second side different from the first side is connectable to the fuel control device;

a sense circuit disposed within the housing, wherein the sense circuit is electrically coupled to the drive pulse line by way of a sense circuit line and is communicably coupled to the engine control unit by way of a data communication line;

a plurality of engine control unit ports disposed along the first side of the housing, wherein the engine control unit ports include a first set of ports and a second set of ports to electrically and communicably couple the engine control unit to the sense circuit; and a plurality of fuel device ports disposed along the second side of the housing, wherein the first set of ports of the engine control unit ports are electrically coupled to the fuel device ports inside the inter-connect circuit device to form a portion of the drive line, such that the drive pulse from the engine control unit flows directly through the housing to the fuel control device.

2. The inter-connect circuit device of claim 1 wherein the sense circuit senses a profile of the drive pulse transmitted through the drive pulse line and performs an initial analysis of the profile.

3. The inter-connect circuit device of claim 2 wherein the sense circuit transmits feedback information to the engine control unit by way of the data communication line, the feedback information includes information regarding the profile of the drive pulse.

4. The inter-connect circuit device of claim 1, wherein the second set of ports electrically and communicably couple the engine control unit to the sense circuit.

5. The inter-connect circuit device of claim 4 wherein:

the second set of ports includes a data communication port and an electric power port, the data communication port communicably couples the sense circuit to the engine control unit, and the electric power port electrically couples the engine control unit to the sense circuit, such that the sense circuit receives electrical power from the engine control unit.

6. The inter-connect circuit device of claim 1 wherein:

the fuel control device includes one or more fuel injectors, and the second side of the housing is coupled to the one or more fuel injectors by way of a fuel injector connector.

7. The inter-connect circuit device of claim 1 wherein the fuel control device is a high pressure fuel pump, and the second side of the housing is coupled to the high pressure fuel pump by way of a fuel pump connector.

8. The inter-connect circuit device of claim 1 wherein the sense circuit includes an application-specific integrated circuit.

9. An inter-connect circuit device for a fuel delivery system of a vehicle, the inter-connect circuit device disposed between an engine control unit and one or more fuel injectors, the inter-connect circuit device transmitting respective drive pulse from the engine control unit to each of the fuel injectors by way of drive pulse lines, the inter-connect circuit device comprising:

a housing having an engine control unit side and a fuel injector side, wherein the engine control unit side is connectable to the engine control unit, and the fuel injector side is connectable to the fuel injectors; and a sense circuit disposed within the housing, the sense circuit having a differential calculation module performing an initial processing by determining an instantaneous voltage differential value indicative of a position of a valve, wherein the sense circuit is electrically coupled to the drive pulse line for each of the fuel injectors by way of a sense circuit line and is communicably coupled to the engine control unit by way of a data communication line.

10. The inter-connect circuit device of claim 9 wherein:

the sense circuit senses a profile of each of the drive pulses transmitted through respective drive pulse lines and calculates feedback information based on the profile, and the sense circuit transmits the feedback information to the engine control unit by way of the data communication line.

11. The inter-connect circuit device of claim 9 wherein the fuel injector side of the housing is connectable to the one or more fuel injectors by way of a fuel injector connector, such that the drive pulse for each of the fuel injectors is transmitted from the engine control unit to each of the fuel injectors by way of the fuel injector connector and the housing.

12. The inter-connect circuit device of claim 9 wherein:

the engine control unit side of the housing includes a drive port for each of the fuel injectors and one or more sense circuit ports to couple the sense circuit to the engine control unit, the fuel injector side of the housing includes a drive port for each of the fuel injectors, and the drive ports on the engine control unit side and the drive ports on the fuel injector side are electrically coupled by way of internal circuity to transmit the drive pulses from the engine control unit.

13. The inter-connect circuit device of claim 12 wherein:

the sense circuit ports include a data communication port and an electric power port, the data communication port communicably couples the sense circuit to the engine control unit, and the electric power port electrically couples the engine control unit to the sense circuit, such that the sense circuit receives electrical power from the engine control unit.

14. The inter-connect circuit device of claim 9 wherein:

each of the drive lines includes a high voltage line and a low voltage line to transmit a respective drive pulse, and the sense circuit is electrically coupled to at least one of the high voltage line and the low voltage line by way of the sense circuit line.

15. The inter-connect circuit device of claim 9 wherein the sense circuit includes an application-specific integrated circuit.

16. An inter-connect circuit device for a fuel delivery system of a vehicle, the inter-connect circuit device disposed between an engine control unit and a high pressure fuel pump, the inter-connect circuit device transmitting a drive pulse from the engine control unit to the high pressure fuel pump by way of a drive pulse line, the inter-connect circuit device comprising:

a housing having an engine control unit side and a fuel pump side, wherein the engine control unit side is connectable to the engine control unit and the fuel pump side is connectable to the fuel pump;

a sense circuit disposed within the housing, wherein the first set of ports of the engine control unit ports are electrically coupled to the fuel device ports inside the inter-connect circuit device to form a portion of the drive line, such that the drive pulse from the engine control unit flows directly through the housing to the fuel control device, the engine control unit side of the housing includes a drive port and one or more sense circuit ports, the fuel pump side of the housing includes a drive port, the drive port on the engine control unit side and the drive port on the fuel pump side are electrically coupled by way of circuity within the housing to transmit the drive pulse from the engine control unit directly to the fuel pump by way of the drive pulse line, and the sense circuit is electrically coupled to the drive pulse line by way of a sense circuit line and is communicably coupled to the engine control unit by way of a data communication line.

17. The inter-connect circuit device of claim 16 wherein:

the sense circuit senses a profile of the drive pulse transmitted through the drive pulse line and calculates feedback information based on the profile, and the sense circuit transmits the feedback information to the engine control unit by way of the data communication line.

18. The inter-connect circuit device of claim 16 wherein:

the engine control unit side of the housing includes a data communication port and an electric power port, the data communication port communicably couples the sense circuit to the engine control unit, and the electric power port electrically couples the engine control unit to the sense circuit, such that the sense circuit receives electrical power from the engine control unit.

19. The inter-connect circuit device of claim 16 wherein the sense circuit includes an application-specific integrated circuit.

* * * * *